United States Patent [19]

Cannella

[11] 4,421,147

[45] Dec. 20, 1983

[54] APPARATUS FOR DISPENSING GRANULAR MATERIAL

[75] Inventor: Samuel M. Cannella, Pine Brook, N.J.

[73] Assignee: E-Z Way Products, Inc., Paterson, N.J.

[21] Appl. No.: 312,692

[22] Filed: Oct. 19, 1981

[51] Int. Cl.[3] ..... B65B 1/04

[52] U.S. Cl. ..... 141/362; 141/371

[58] Field of Search ..... 141/351-362, 141/369-381

[56] References Cited

U.S. PATENT DOCUMENTS

| | | | |
|---|---|---|---|
| 3,000,409 | 9/1961 | Thomasco | 141/358 |
| 3,177,908 | 4/1965 | Kaufman | 141/358 |
| 4,130,149 | 12/1978 | Hausam | 141/358 |
| 4,232,718 | 11/1980 | Wippermann | 141/358 |

FOREIGN PATENT DOCUMENTS

| | | | |
|---|---|---|---|
| 573657 | 2/1958 | Italy | 141/362 |

*Primary Examiner*—Houston S. Bell, Jr.
*Attorney, Agent, or Firm*—Kenneth P. Glynn

[57] ABSTRACT

The present invention is directed to an apparatus for dispensing granular material from a storage box container. The device includes a housing, having substantially vertical side walls and a receiving base, the receiving base having three planar surfaces all of which are located substantially within the vertical side walls and at right angles to the vertical side walls being located so as to retain a storage box container at an adequate angle to permit gravity flow of granular material. The apparatus also contains a main rail connected to the underside of the mentioned housing, the main rail having sliding structure capable of receiving a main slide so as to permit forward and reverse movement of the main slide wathan said main rail, the mail raal also having an opening therein coinciding with the dispensing opening of the housing and having a recess therein around it opening for receiving a gasket, with the gasket being fixedly located within the recess. Also included is a main slide located so as to permit the flow of granular material out of the apparatus by gravity flow when located in a first position and to fully stop gravity flow of granular material when located in a second position, the main slide also having structure for attaching a receiving device under the main slide opening so that the receiving device may be removably attached thereto and may receive granular material flowing out of the apparatus.

2 Claims, 3 Drawing Figures

APPARATUS FOR DISPENSING GRANULAR MATERIAL

BACKGROUND OF THE INVENTION

The present invention relates to an apparatus for the dispensing of granular material from a storage box container. More particularly, the present invention relates to an apparatus for the convenient dispensing of granular material from a container into a receiving device in predetermined amounts.

Certain types of granular materials such as soaps and detergents, swimming pool chemicals, certain industrial and commercial powders and the like are obtained by the user in large storage box containers, such as the five pound "King Size" box of laundry detergent or the four pound container of swimming pool additive. While purchases of these granular materials are economic in such large sizes, the user is confronted with the difficulty of having to dispense small, relatively accurate quantities of the granular materials into receiving means, e.g. measuring cups. It is extremely difficult, for example, for the average user to pick up a five pound box of soap powder and pour a specified amount, e.g. 1½ cups into a 2 cup size measuring cup. Not only is the filling very inaccurate and frequently excess powder must be returned to the box, but also spillage of the granules is a frequent occurrence.

The present invention is directed to the minimization of the inaccuracies, energies expended and spillages which occur when the user of large storage box containers of granular material dispense the material into smaller receiving devices. Thus, the present invention enables the user to dispense the granular material with more accuracy, more quickly, less spillage, and less effort than currently employed.

PRIOR ART STATEMENT

The only prior art of interest available at the time of filing of this application is an Official Gazette summary of U.S. Pat. No. 4,232,718, entitled "Device For The Portioned Removal of Granules," filed Nov. 7, 1978, foreign priority, Federal Republic of Germany, Nov. 8, 1977, issued to Gerhard Wippermann (Official Gazette, Nov. 11, 1980, copy enclosed). The invention is directed to a device for the dosed removal of granules from storage containers, particularly household packages of coffee, tea or the like, comprising a storage container comprising, a bottom wall defining a discharge opening, means defining a channel under said bottom wall, said channel opening toward a transverse side of said storage container, a closure slider slidably disposed in said channel, a spoon adapted to be pushed into said channel, said spoon being shaped complementarily to the cross-section of said channel, said spool forming a trough having an edge spanning a larger surface than that of said discharge opening, said spoon having a front face edge abuttingly pressing back said closure slider when said spoon is inserted in said channel, said closure slider being adapted to be pressed back against spring action, said closure slider being formed with a front surface, said front face edge of said spoon being shaped to the shape of said front surface of said closure slider, said bottom wall defines at least one prechamber above said discharge opening, at least one division wall connected with said closure slider, said at least one prechamber is covered by said at least one division wall in a closing position of said closure slider.

The Wippermann invention is considerably different from the present invention in that it requires a storage compartment as an integral part of the device, requiring greater production costs, does not utilize the originally purchased storage box container as does the present invention, by necessity requires a spring loaded closure slider (otherwise the dispensing part would not close) and a receiving cup of a singular size (total volume). The present invention, however, permits the user to employ the original storage box container of the granular material, does not require significant materials of manufacture to be wasted as a totally integrated storage means, needs no spring, inherently closes the dispensing opening upon completion of utilization due to its inherent design, and only requires receiving means of a certain top dimension, but many different total volume configurations may be employed. Other differences over this prior art and advantages of the present invention will become apparent from the following disclosure.

BRIEF DESCRIPTION OF THE PRESENT INVENTION

The present invention is directed to an apparatus for dispensing granular material from a storage box container. The device includes a housing, having substantially vertical side walls and a receiving base, the receiving base having three planar surfaces all of which are located substantially within the vertical side walls and at right angles to the vertical side walls, the three planar surfaces being a first planar surface and a second planar surface at a right angle to one another, and a third planar surface separating the first planar surface and the second planar surface, the third planar surface being substantially horizontal and having a dispensing opening therein, the first and second planar surfaces being located so as to retain a storage box container at an adequate angle to permit gravity flow of granular material. The apparatus also contains a main rail connected to the underside of the mentioned housing, the main rail having sliding means capable of receiving a main slide so as to permit forward and reverse movement of the main slide within said main rail, the main rail also having an opening therein coinciding with the dispensing opening of the housing and having a recess therein around its opening for receiving a gasket, with the gasket being fixedly located within the recess. Also included in a main slide, slidably connected to the sliding means of the main rail so as to permit its forward and reverse movement, the main slide having a main slide opening therein located so as to be coinciding with the dispensing opening of the housing when the main slide is in a first position and so as to be fully non-coincidental with the dispensing opening when said main slide is in a second position, and located so as to permit the flow of granular material out of the apparatus by gravity flow when located in a first position and to fully stop gravity flow of granular material when located in a second position, the main slide also having means for attaching a receiving device under the main slide opening so that the receiving device may be removably attached thereto and may receive granular material flowing out of the apparatus.

DETAILED DESCRIPTION OF THE PRESENT INVENTION AND THE DRAWINGS

Figure 1:
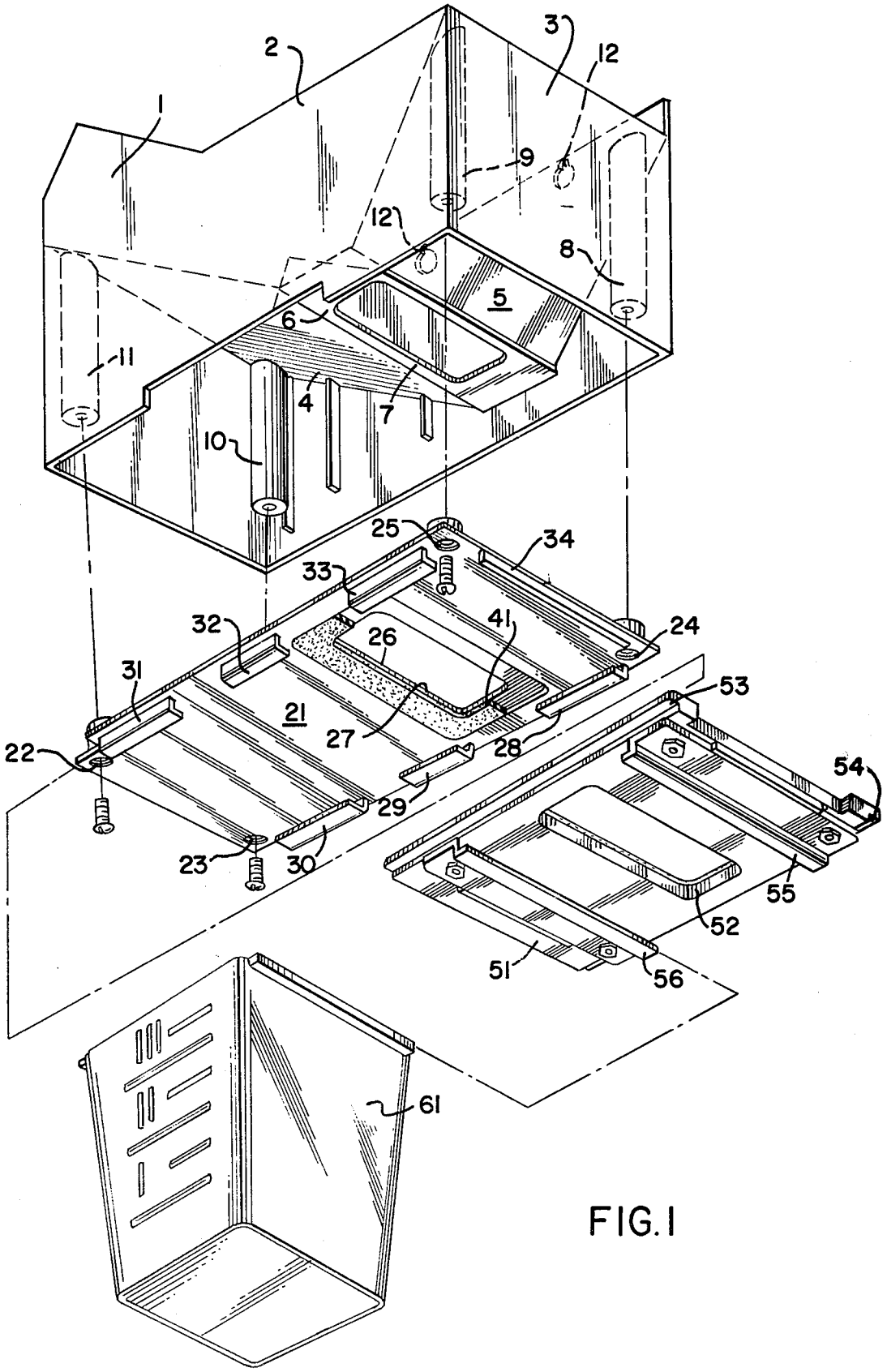
FIG. 1 illustrates a preferred embodiment of the apparatus of the present invention with an unassembled perspective view.

FIG. 1 shows the perspective view of a preferred embodiment. The housing (1) contains side walls (2) and (3) which are shown to be substantially vertical, and a receiving base made up of three planar surfaces (4), (5) and (6). As shown, surfaces (4), (5) and (6) are all located within the side walls (2) and (3). The three planar surfaces (4), (5) and (6) comprise a first planar surface (4) and a second planar surface (5) which are at right angles to one another. The third planar surface (6) separates the other two planar surfaces (4) and (5) and is substantially horizontal, as shown. Horizontal planar surface (6) has a dispensing opening (7) therein. As shown, the first and second planar surfaces (4) and (5) are not only at right angles to one another but are themselves positioned so as to be capable of retaining a storage box container at an adequate angle to permit gravity flow of granular material. This aspect will be more fully described below with respect to FIGS. 2 and 3.

In FIG. 1, main rail (21) is positioned so as to be connectable to housing (1) at its underside. Main rail (21) may be attached to housing (1) by any conventional means, and the screws and channels (22), (23), (24) and (25) and the securing means (8), (9), (10) and (11) are merely illustrative. Main rail (21) is designed so as to receive a main slide (51) and so as to permit forward and reverse motion of main slide (51). Main rail (21) includes sliding means illustrated here as six rail segments (28), (29), (30), (31), (32) and (33). Main rail (21) also contains a main rail opening (26) which coincides with dispensing opening (7) of housing (1). The main rail opening (26) is surrounded by a gasket recess (27), as shown.

Main slide (51) is designed so that its ledges (53) and (54) slidably fit into the rail segments (28) through (33), and gasket (41) fits tightly into recess (27). Main slide (51) contains a main slide opening (52), as shown. The main slide (51) with its opening (52) is slidable in a forward and reverse direction within the main rail (21) so that in a first position the main slide opening (52) is fully coincidental with openings (26) and (7), and so that in a second position the main slide opening (52) is fully non-coincidental with openings (26) and (7). This will enable the selective flow by gravity of granular material into receiving device (61). As shown, main slide (51) contains gibs (55) and (56) designed for the attachment and removal of receiving means (61) (cup, as shown).

Figure 2:
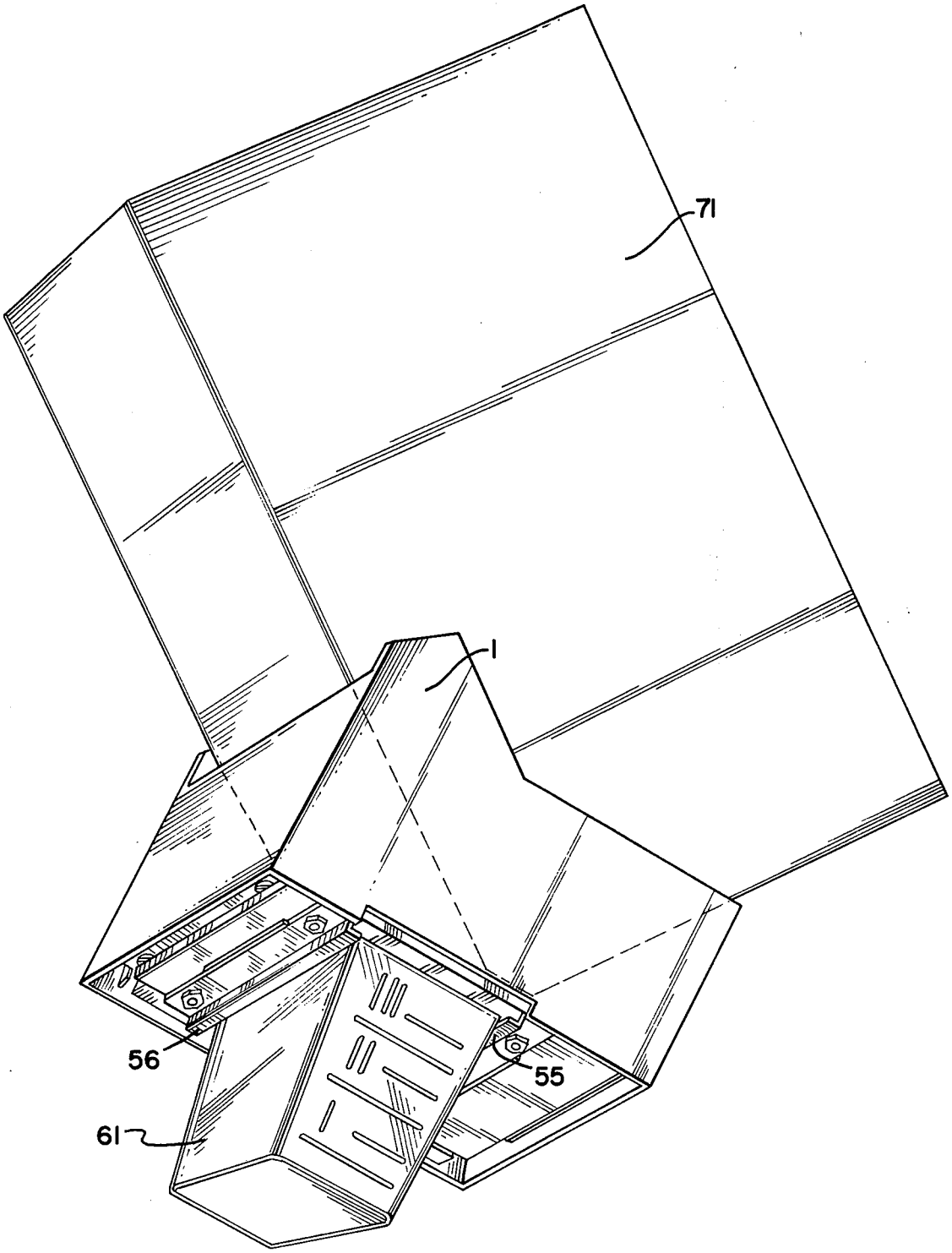
FIG. 2 shows a perspective view of a preferred embodiment of the apparatus of the present invention with a storage box container and a receiving device (cup); and, FIG. 3 illustrates a cut side view of a preferred embodiment of the present invention showing a portion of a storage container box with granular material and showing a granular material receiving device.

FIG. 2 shows receiving means (61) inserted into and removably attached to gibs (55) and (56) so that they may be slid forward and backward along the main rail (21) illustrated in detail in FIG. 1. Also, illustrative of the present invention use is the insertion of detergent storage box container (71) into housing (1).

Figure 3:
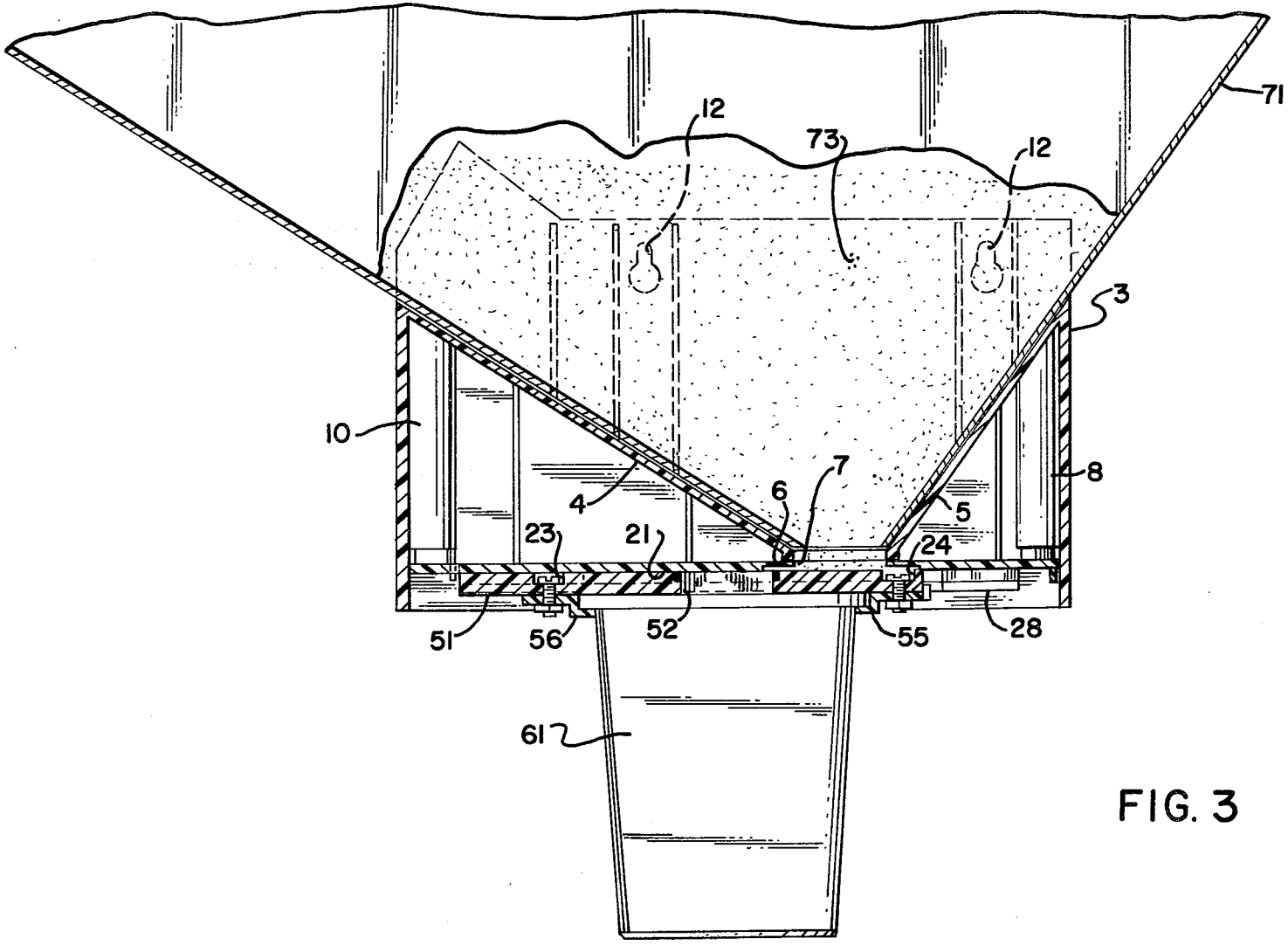

As seen in FIG. 3, discussed in conjunction with FIG. 1 as to aspects not numbered in FIG. 3, container (71) is inserted and sits held in position by planar surfaces (3), (4) and (5). The container (71) has its corner cut off so as to permit selective flow of granular material (73) through dispensing opening (7) and main rail opening (26) (shown in FIG. 1). The receiving means (61) is slipped onto gibs (55) and (56) and then the receiving means (61) and the main slide (51) may be moved forward and backward so that main slide opening (52) may be placed directly under openings (7) and (26). The gasket (41) prevents undesired spillage and/or jamming of the slide mechanism during use. When the opening (52) is positioned under the openings (7) and (26), granular material (73) will flow into receiving means (61) to a desired fill level, and the user, by merely moving the main slide (51) and receiving means (61) backward, will shut off the flow of granular material (73).

FIG. 3 also illustrates optional vertical surface mounting means (12) so that the apparatus of the present invention may be wall mounted with screws or nails or otherwise mounted as desired.

The apparatus of the present invention may preferrably be made of components (housing, main rail, main slide, etc.) contructed of unistructural plastic. The gasket may be felt, cork, cellular plastic, rubber or other functional synthetic material.

Although the Figures describe a particular embodiment of the present invention, other variations and alternatives to the foregoing should now be apparent to the artisan and will not exceed the scope of the present invention. For example, an optional safety locking device may be employed to prevent the inadvertent sliding of the main slide of the apparatus of the present invention, e.g. by children. This may be a manual locking pin or it may be an automatic spring loaded locking pin which disengages when the receiving device is inserted.

What is claimed is:

1. An apparatus for dispensing granular material from a storage box container, comprising:

(a) a housing having side walls and a receiving base, the receiving base having a dispensing opening therein, said side walls and receiving base being positioned so as to retain a storage box container at an adequate angle to permit gravity flow of granular material;

(b) a main rail connected to the underside of said housing, said main rail having sliding means capable of receiving a main slide so as to permit forward and reverse movement of said main slide with said main rail, said main rail also having an opening therein coinciding with said dispensing opening of said housing;

(c) a main slide, slidably connected to said sliding means of said main rail so as to permit its forward and reverse movement, said main slide having a main slide opening therein located so as to be coinciding with said dispensing opening of said housing when said main slide is in a first position and so as to be fully non-coincidental with said dispensing opening when said main slide is in a second position, and located so as to permit the flow of granular material out of said apparatus by gravity flow of granular material when located in said second position, said main slide also having means for attaching a receiving device under said main slide opening so that the receiving device may be removably attached thereto and may receive granular material flowing out of said apparatus; and, (d) a receiving device capable of attachment to said main slide.

2. The apparatus of claim 1 wherein said housing main rail and main slide are each made of unistructural plastic construction.

* * * * *